US008898975B2

(12) United States Patent
Tsai

(10) Patent No.: US 8,898,975 B2
(45) Date of Patent: Dec. 2, 2014

(54) DRY-HANG WALL PANEL USING A THIN STONE SLAB

(71) Applicant: Che-An Tsai, Kaohsiung (TW)

(72) Inventor: Che-An Tsai, Kaohsiung (TW)

( * ) Notice: Subject to any disclaimer, the term of this patent is extended or adjusted under 35 U.S.C. 154(b) by 0 days.

(21) Appl. No.: 13/875,544

(22) Filed: May 2, 2013

(65) Prior Publication Data

US 2014/0325927 A1 Nov. 6, 2014

(51) Int. Cl.
*E04B 2/90* (2006.01)
*E04F 13/08* (2006.01)

(52) U.S. Cl.
CPC ..... *E04F 13/0873* (2013.01)
USPC ..... 52/235; 52/509; 52/506.08

(58) Field of Classification Search
CPC ..... E04F 13/0826; E04F 13/0821; E04F 13/0803; E04B 2/90; E04B 1/2403; E04B 2001/405
USPC ..... 52/235, 506.01, 506.05, 506.06, 52/506.07, 506.08, 506.09, 479, 483.1, 52/489.1, 489.2, 762, 509–510, 512–513, 52/391–392, 474, 764, 770, 772, 775, 52/777–781, 459–460, 470, 600–601; 248/216.1, 216.4, 200, 300
See application file for complete search history.

(56) References Cited

U.S. PATENT DOCUMENTS

| | | | | | |
|---|---|---|---|---|---|
| 752,530 | A * | 2/1904 | Dobbin | 52/355 |
| 3,235,039 | A * | 2/1966 | O'Donnell | 52/235 |
| 3,266,210 | A * | 8/1966 | Grossman | 52/690 |
| 3,336,707 | A * | 8/1967 | Horgan, Jr. | 52/281 |
| 4,107,887 | A * | 8/1978 | Wendt | 52/105 |
| 4,409,768 | A * | 10/1983 | Boden | 52/309.4 |
| 4,768,321 | A * | 9/1988 | Crandell | 52/235 |
| 5,092,100 | A * | 3/1992 | Lambert et al. | 52/774 |
| 5,301,484 | A * | 4/1994 | Jansson | 52/235 |
| 5,611,185 | A * | 3/1997 | Wilz | 52/506.07 |
| 5,709,058 | A * | 1/1998 | Shaw | 52/404.1 |
| 5,740,644 | A * | 4/1998 | Menchetti | 52/281 |
| 5,860,257 | A * | 1/1999 | Gerhaher et al. | 52/235 |
| 6,098,364 | A * | 8/2000 | Liu | 52/506.08 |
| 6,205,733 | B1 * | 3/2001 | LaLonde | 52/506.07 |
| 6,289,646 | B1 * | 9/2001 | Watanabe | 52/506.01 |
| 6,425,218 | B1 * | 7/2002 | Doyon et al. | 52/235 |
| 6,505,448 | B2 * | 1/2003 | Ito | 52/474 |
| 2005/0246983 | A1 * | 11/2005 | Loyd | 52/235 |
| 2008/0010927 | A1 * | 1/2008 | Wilson et al. | 52/387 |
| 2009/0031652 | A1 * | 2/2009 | Ortega Gatalan | 52/235 |
| 2011/0283635 | A1 * | 11/2011 | Sato et al. | 52/173.3 |

* cited by examiner

*Primary Examiner* — Brian Glessner
*Assistant Examiner* — Beth Stephan

(57) ABSTRACT

A dry-hang wall panel includes a thin stone slab having a thickness of about 3-10 mm. A reinforcing sheet has an area corresponding to the thin stone slab and is fixed to a rear side of the thin stone slab. A rear frame made of a rigid material is fixed to a peripheral edge of the reinforcing sheet. The rear frame has a hollow area in a central portion thereof. Hooks can be mounted to the rear frame for mounting the dry-hang wall panel to a wall face. The dry-hang wall panel allows easy construction and provides a leveling effect while providing a sense of quality.

9 Claims, 12 Drawing Sheets

DRY-HANG WALL PANEL USING A THIN STONE SLAB

BACKGROUND OF THE INVENTION

The present invention relates to a dry-hang wall panel using a thin stone slat and, more particularly, to a light dry-hang wall panel allowing easy construction while providing a smooth appearance with a sense of quality.

An outer wall of a building is generally painted or mounted with tiles, steel panels, stone slabs, etc. to provide enhanced appearance quality. Stone slabs are popular due to their natural aesthetic patterns although they are expensive. The stone slabs are generally mounted on a wall by hang-dry or wet-type constructing methods. In the hang-dry method, hangers are fixed to a wall of a building for engaging with hooks fixed to stone slabs. The dry-hang method is faster than the wet-type method requiring a longer period of time for the cement to harden. Furthermore, it is not necessary to remove the old wall panels initially mounted to the outer wall of an old building in the dry-hang method. The hangers can be directly fixed to the old wall panels to rapidly construct a new wall panel, reducing the construction time while meeting the user needs.

Conventionally, the stone slabs have a thickness of abut 18-30 mm after cutting, avoiding breakage during transportation. An end of each stone slab is processed to form a hole or a groove for coupling with a hook, allowing the stone slab to be mounted to a wall face by the dry-hang method, examples of which are disclosed in Taiwan Utility Model Nos. M397404 and M261538. However, many workers are needed to carry the stone slabs having a thickness larger than 18 mm, causing inconvenience to construction and increasing the costs. Furthermore, it is difficult to construct a ceiling with these stone slabs. Further, people may be injured while carrying the stone slabs in a building. Further, the stone slabs may crack while forming the hole or groove, and formation of the hole or groove is not easy. Further, the heavy stone slabs mounted to the wall face are liable to break or even fall down in an earthquake.

Furthermore, the resources of natural stone slabs lessen due to continuing quarrying. Thus, use of the stone slabs having a thickness larger than 18 mm is not friendly to the environment and significantly increases the costs of the outer wall.

In a solution disclosed in Taiwan Utility Model Nos. M397403 and M330319, a composite stone slab structure includes a thin stone slab having a thickness of 3-10 mm and a reinforcing material mounted to a rear side of the thin stone slab. Thus, a stone slab having a thickness of 18-30 mm can be divided into two or more thin stone slabs of the same area to reduce the costs while providing environmental protection in addition to presenting the natural stone patterns when the thin stone slabs are bonded to a wall face.

However, the individual thin stone slab having a large area is liable to bend and deform. Although the thin stone slab can be reinforced by engaging with a thick reinforcing material, the thick reinforcing material increases the overall weight and is difficult to install. Furthermore, the surface of the thick reinforcing material is apt to bend due to difficulties in leveling, resulting in an uneven wall face.

BRIEF SUMMARY OF THE INVENTION

An objective of the present invention is to provide a dry-hang wall panel allowing easy construction to form a smooth dry-hang wall panel or ceiling.

A dry-hang wall panel according to the present invention includes a thin stone slab having a thickness of about 3-10 mm. A reinforcing sheet has an area corresponding to the thin stone slab and is fixed to a rear side of the thin stone slab. A rear frame made of a rigid material is fixed to a peripheral edge of the reinforcing sheet. The rear frame has a hollow area in a central portion thereof.

In examples, the rear frame includes a plurality of elongated beams connected to each other. Each elongated beam has a side fixed to the peripheral edge of the reinforcing sheet. Two ends respectively of two adjacent elongated beams are fixed to each other. The elongated beams together define a hollow section. The ends respectively of two adjacent elongated beams are fixed to each other by a connection plate. The reinforcing sheet is fixed to the thin stone slab by glue, and the rear frame is fixed to the reinforcing sheet by glue. Hooks are mounted to the rear frame and can be fixed to a wall face.

In an example, each elongated beam of the rear frame includes a coupling section and a frame section. The coupling section is engaged with the reinforcing sheet. The coupling section includes a coupling groove receiving the peripheral edge of the thin stone slab and the peripheral edge of the reinforcing sheet. The coupling groove further includes a lip enveloping a front face of the peripheral edge of the thin stone slab.

In another example, a recess is formed in the front face of the peripheral edge of the thin stone slab, with the lip of each of the plurality of elongated beams received in the recess.

In a further example, each elongated beams has a groove.

In another example, a reinforcing rib is connected between two of the elongated beams.

The present invention will become clearer in light of the following detailed description of illustrative embodiments of this invention described in connection with the drawings.

DETAILED DESCRIPTION OF THE INVENTION

Figure 1:
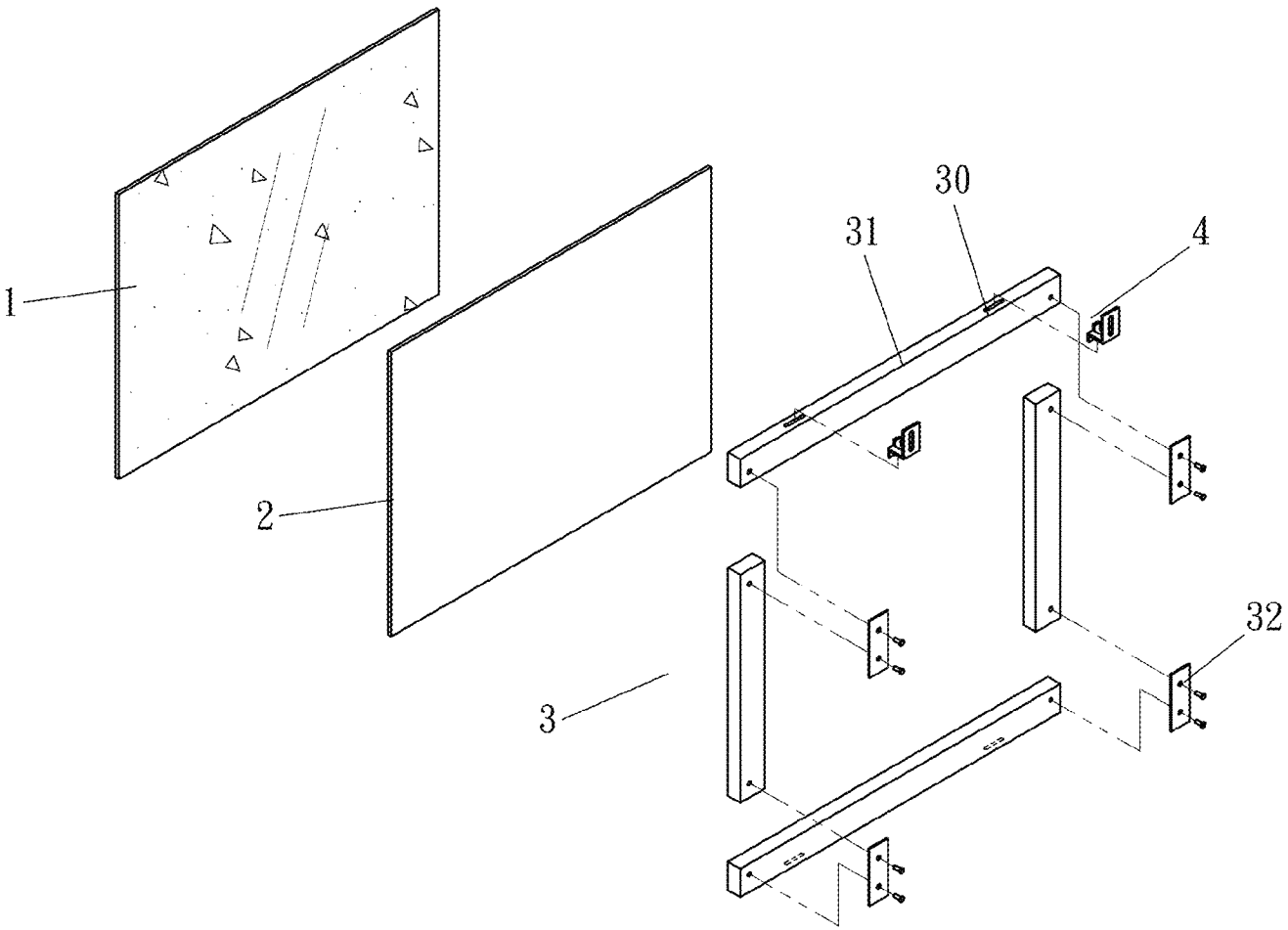
FIG. 1 is an exploded, perspective view of a dry-hang wall panel of a first example according to the present invention.
Figure 2:
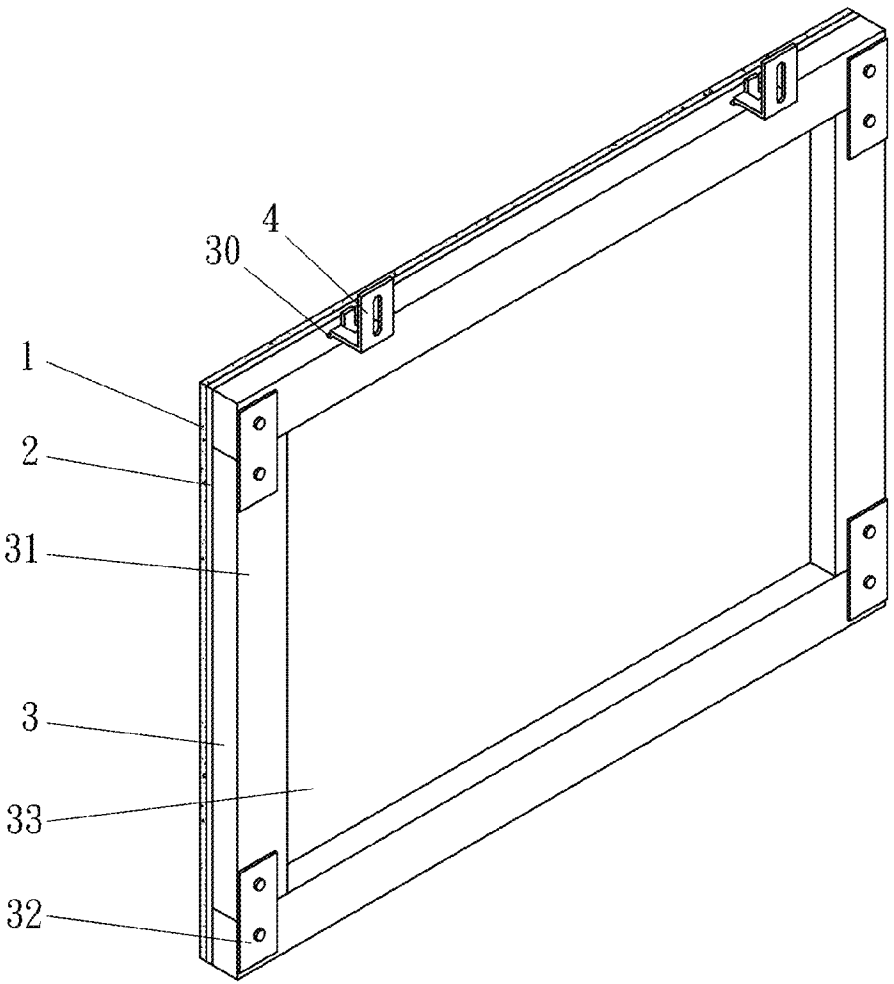
FIG. 2 is a perspective view of the dry-hang wall panel of FIG. 1.
Figure 3:
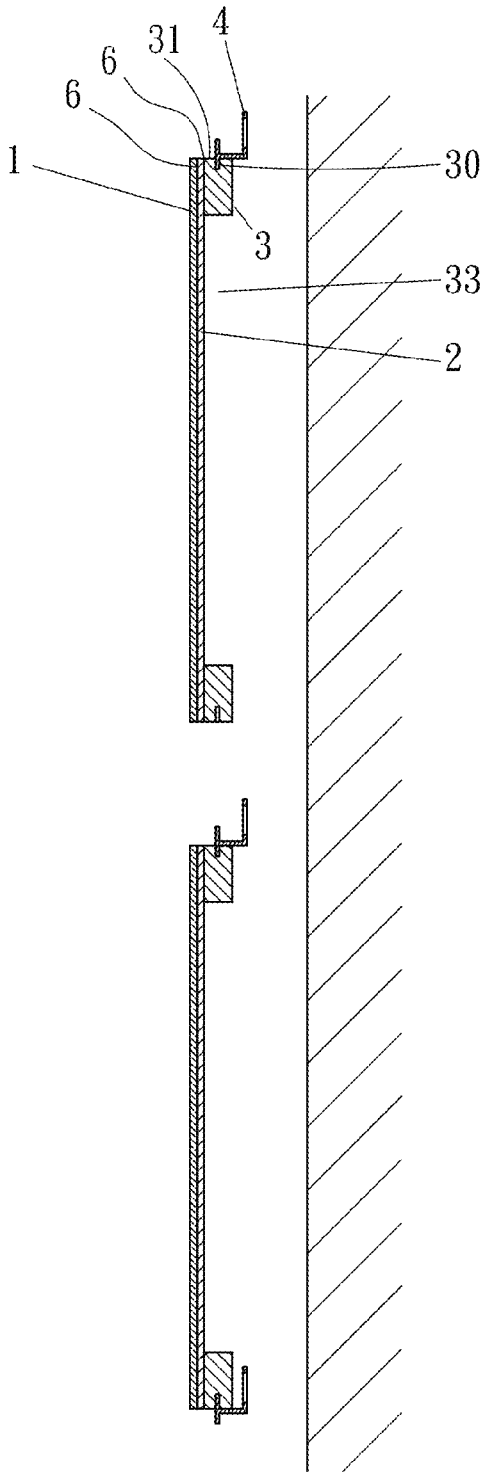
FIG. 3 is a cross sectional view of two dry-hang wall panels of FIG. 1 and a wall.

With reference to FIGS. 1-3, a dry-hang wall panel of a first example according to the present invention includes a thin stone slab 1, a reinforcing sheet 2, and a rear frame 3. The thin stone slab 1 has a thickness of about 3-10 mm. The reinforcing sheet 2 has an area corresponding to that of the thin stone slab 1 and is bonded by glue 6 to a rear side of the thin stone slab 1. The reinforcing sheet 2 can be a foamed temperature-keeping board made of high-density polyethylene (HDPE) or extruded polystyrene (XPS), a sheet made of foamed expanded polystyrene, polypropylene, calcium silicate, or magnesium oxide, or an aluminum honeycomb panel. The reinforcing sheet 2 is light and enhances the strength of the thin stone slab 1.

The rear frame 3 is made of aluminum, wood, stainless steel, steel pipes coated with zinc, or other rigid material less likely to deform. The rear frame 3 includes four elongated beams 31 each having a side fixed by glue 6 to a peripheral edge of a rear side of the reinforcing sheet 2. The elongated beams 31 are fixed to each other to form a rectangular structure having a hollow section 33 defined by the elongated beams 31. A connection plate 32 is used to fix to two ends respectively of two adjacent elongated beams 31. The elongated beams 31 mounted to the rear side of the reinforcing sheet 2 increases the leveling effect between the peripheral edges of the reinforcing sheet 2 and the thin stone slab 1. Even if the thin stone slab 1 and the reinforcing sheet 2 have an area greater than 60×60 cm, the thin stone slab 1 can still be leveled by the elongated beams 31. The area of the rear frame 3 does not have to correspond to the thin stone slab 1, providing a light structure. Furthermore, the hollow section 33 provides a space for heat insulation effect and sound buffering effect. The rear frame 3 further includes insertion holes 30, and hooks 4 are engaged in the insertion holes 30. The hooks 40 can be of any desired form as conventional including but not limited to of a commercially available type.

Figure 4:
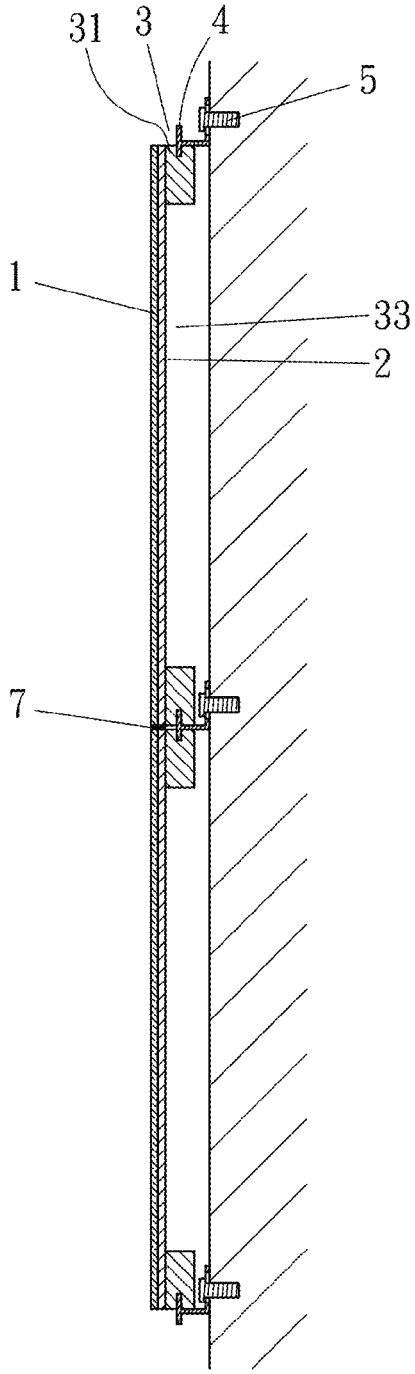
FIG. 4 is a cross sectional view of the dry-hang wall panels of FIG. 3 mounted to the wall.
Figure 5:
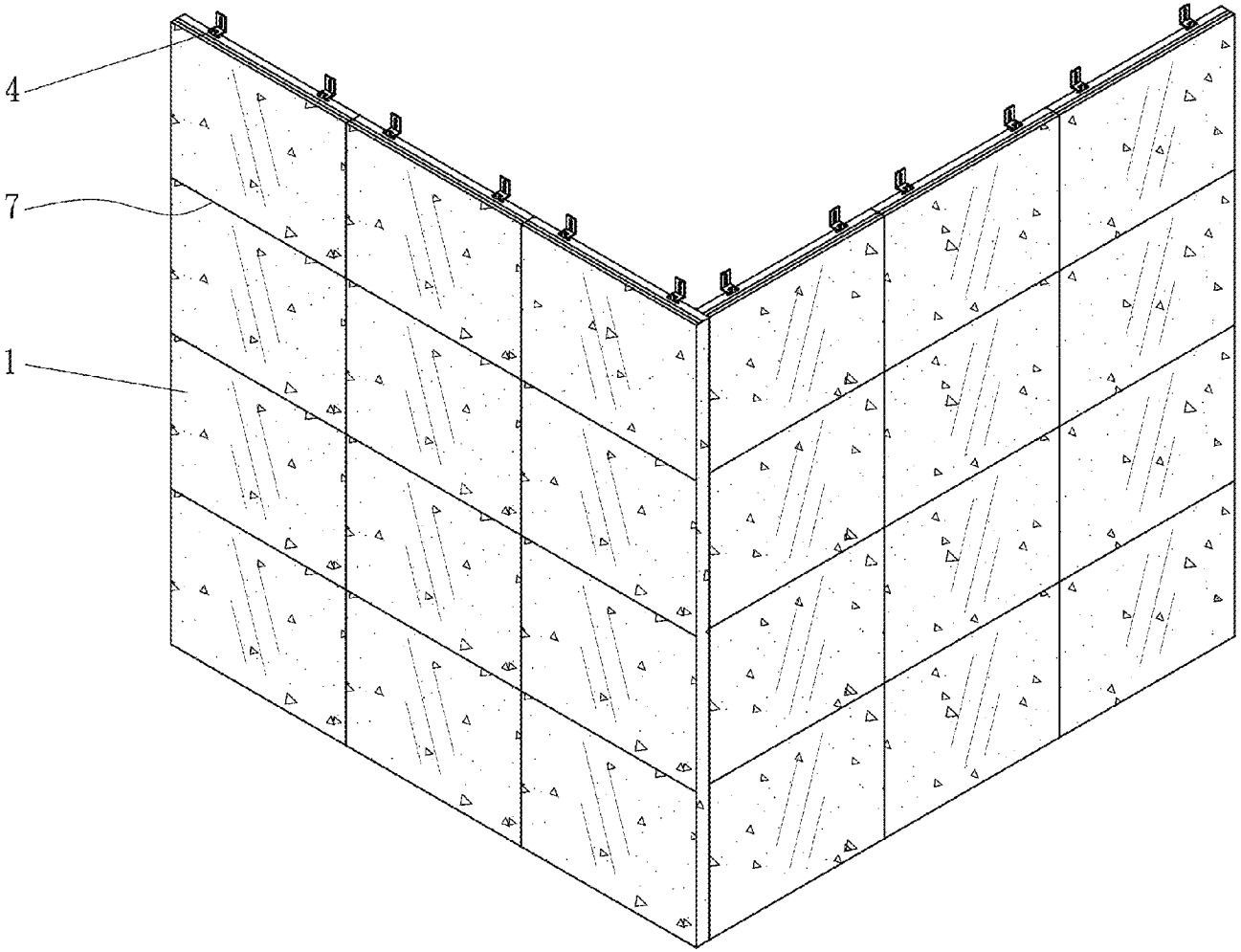
FIG. 5 is a perspective view illustrating a right-angled wall covered with the dry-hang wall panels of FIG. 1.

With reference to FIGS. 4 and 5, when mounted to a wall face, a plurality of the wall panels according to the present invention is produced in advance through module production. The wall panels are stacked in the vertical direction. The hooks 4 are fixed to the wall face by fasteners 5. A putty layer 7 can be provided between two adjacent wall panels to increase the sense of quality.

The rear frame 3 is not of full frame type to reduce the costs and has a low weight to reduce the load to the wall of the building while allowing easy carriage by workers during construction. The hooks 4 can be mounted to the rear frame 3 without damaging the thin stone slab 1. The elongated beams 31 of the rear frame 3 are strong enough to resist deformation. Thus, the elongated beams 31 are coupled to the peripheral edge of the reinforcing sheet 2 to prevent deformation of the wall panel even if the wall panel has a large area. As a result, the whole wall face can have better leveling without using a thick reinforcing sheet 2. The wall panel according to the present invention avoids the disadvantage of easy bending of large-area thin stone slabs 1, allowing use of large-area wall panels on the wall face to improve the sense of quality. The surface of a building using the wall panels according to the present invention can be smooth for aesthetic purposes. Furthermore, the wall panels according to the present invention can be mounted to an inner wall of a building. Further, the wall panels according to the present invention are light and, thus, can be mounted to a ceiling, providing enhanced utility.

Figure 6:
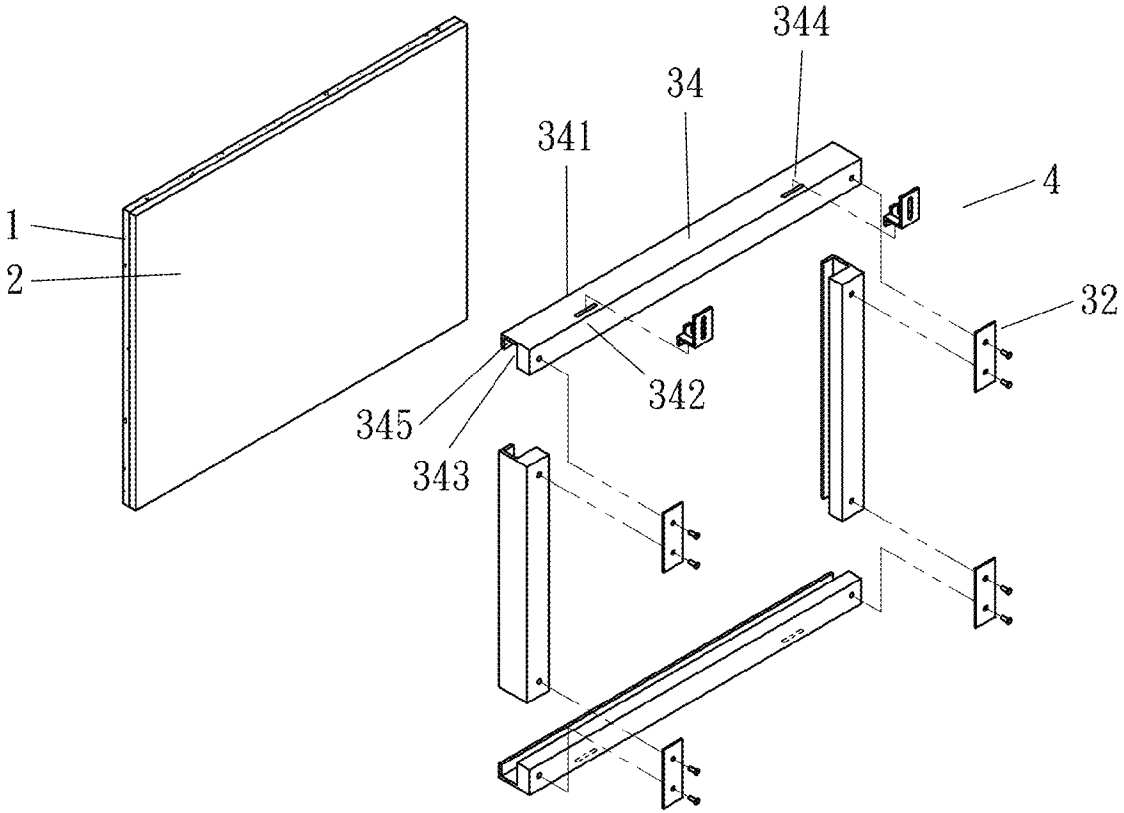
FIG. 6 is an exploded, perspective view of a dry-hang wall panel of a second example according to the present invention.
Figure 7:
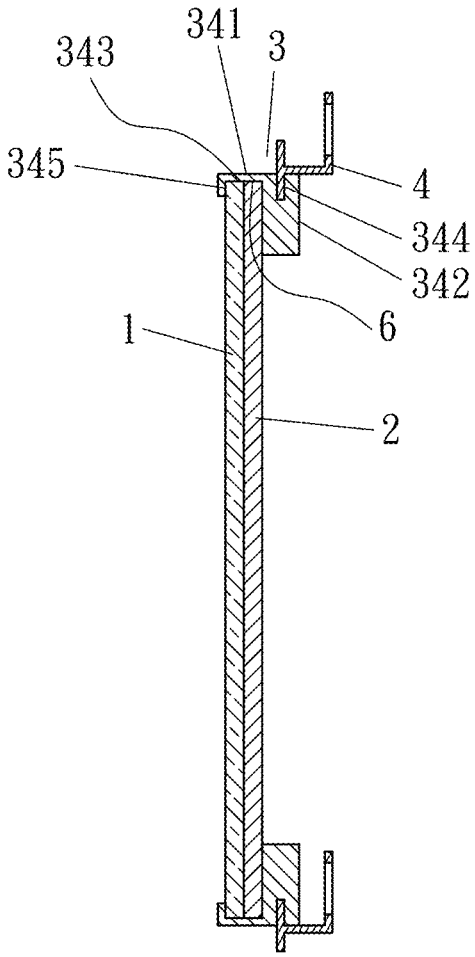
FIG. 7 is a cross sectional view of the dry-hang wall panel of FIG. 6.
Figure 8:
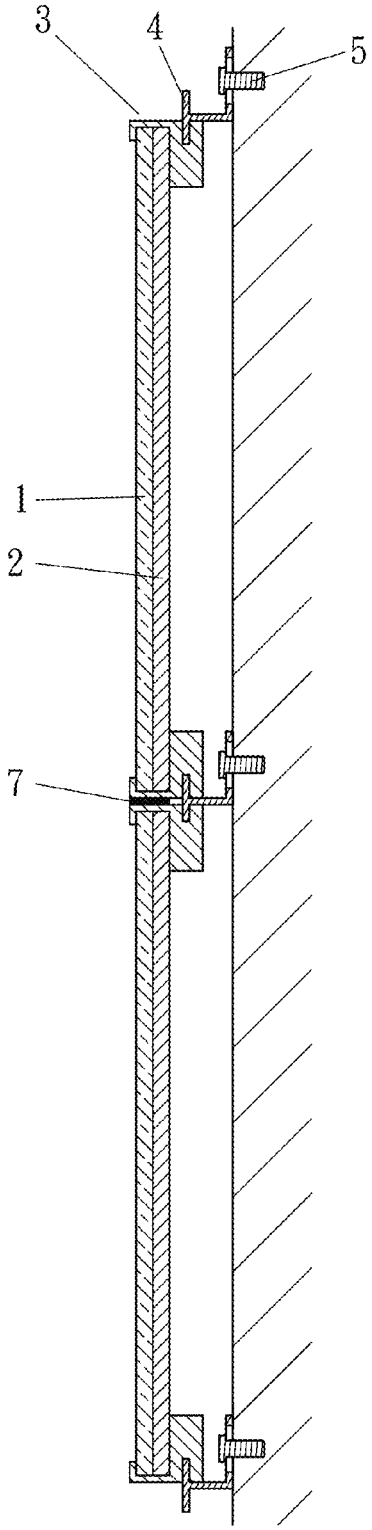
FIG. 8 is a cross sectional view of two dry-hang wall panels of FIG. 7 mounted to a wall.
Figure 9:
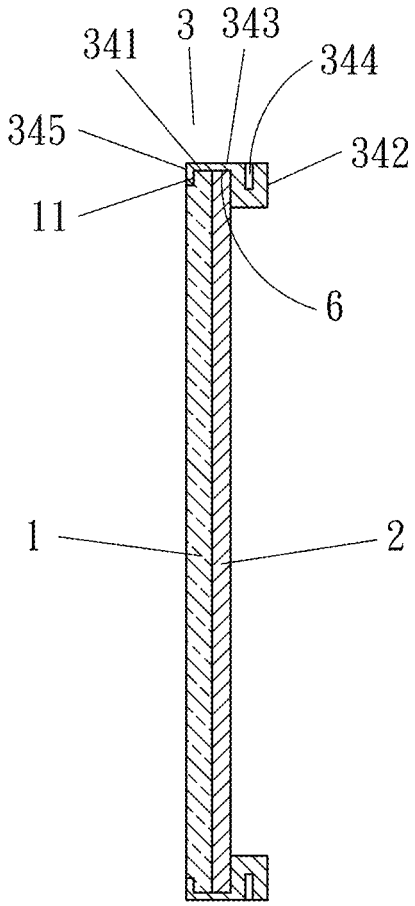
FIG. 9 is a cross sectional view of a dry-hang wall panel of a third example according to the present invention.

FIGS. 6-8 show a wall panel of a second example according to the present invention. In this example, each elongated beam (now designated 34) of the rear frame 3 includes a coupling section 341 on a side thereof and a frame section 342 on the other side thereof. The coupling section 341 includes a coupling groove 343 for receiving an edge of the thin stone slab 1 and an edge of the reinforcing sheet 2. The coupling groove 343 includes a lip 345 for enveloping a front face of the peripheral edge of the thin stone slab 1. Insertion holes 344 are formed in the frame section 342 for coupling with hooks 4. In assembly, the edges of the thin stone slab 1 and the reinforcing sheet 2 are received in the coupling groove 343 of the coupling section 34 and fixed by glue 6, providing enhanced engagement. A connection plate 32 is used to fix to two ends respectively of two adjacent elongated beams 34, forming the rear frame 3. The wall panel is mounted to a wall face by fasteners 5 extending through the hooks 4. FIG. 9 show a third example of the wall panel similar to the second example, wherein a recess 11 is formed in a front face of the peripheral edge of the thin stone slab 1, and the lip 345 of each elongated beam 34 is received in the recess 11. The lip 345 can have a color corresponding to the thin stone slab 1, providing a smoother appearance and a sense of integrity.

Figure 10:
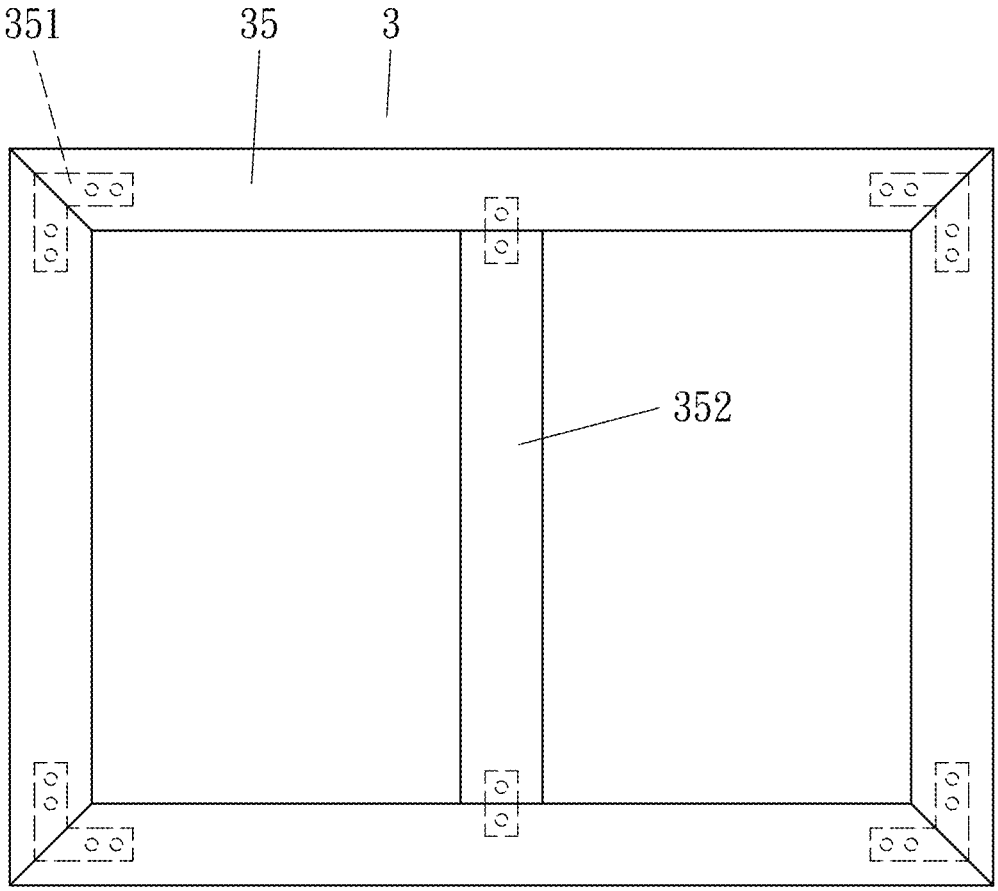
FIG. 10 is a plan view illustrating a rear frame of a dry-hang wall panel of a fourth example according to the present invention.

FIG. 10 shows a fourth example of the wall panel, wherein the elongated beams (now designated 35) of the rear frame 3 are hollow. An angled connection plate 351 is used to fix to two ends respectively of two adjacent elongated beams 35. Furthermore, a reinforcing rib 352 can be provided between two longer elongated beams 34 in a case that the wall panel has a large area, increasing the strength for use on a large wall face.

Figure 11:
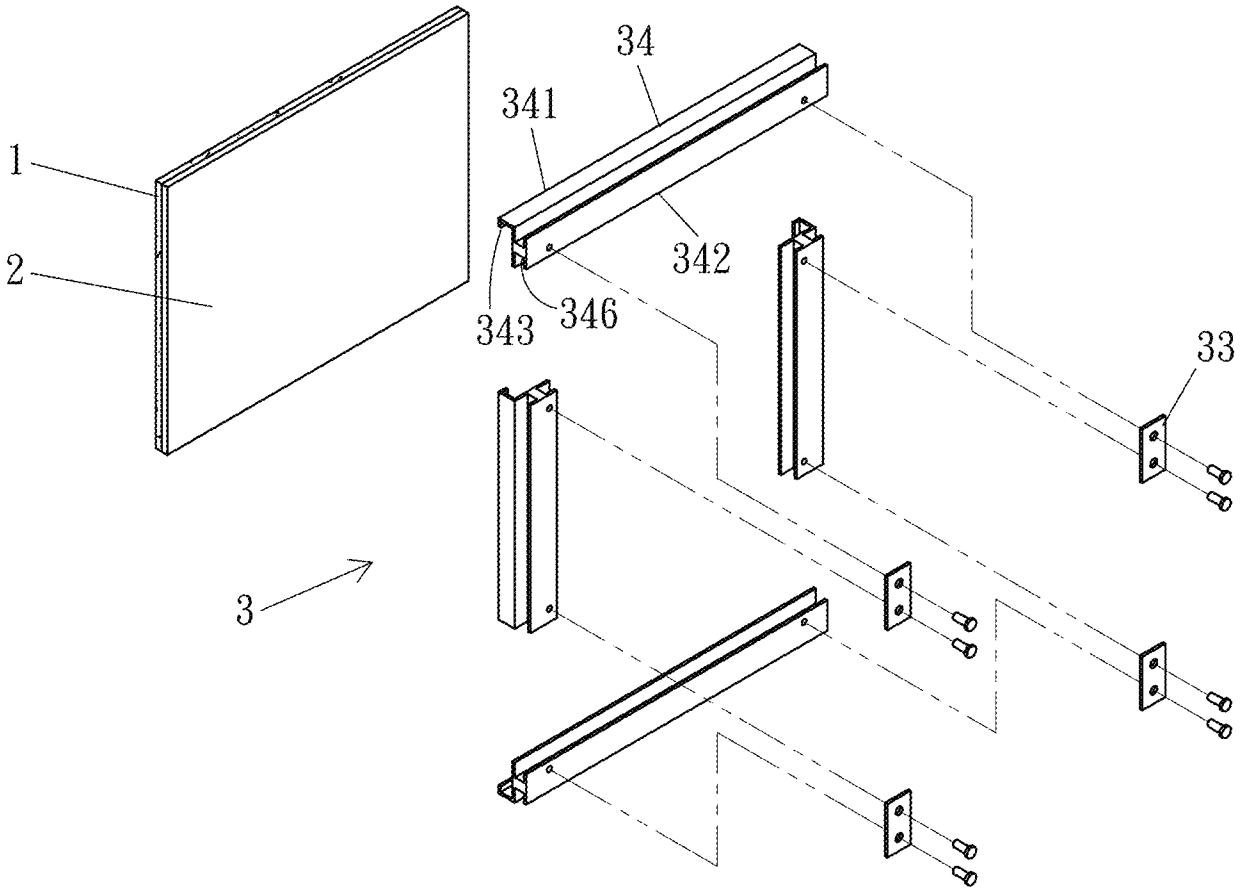
FIG. 11 is an exploded, perspective view of a dry-hang wall panel of a fifth example according to the present invention.
Figure 12:
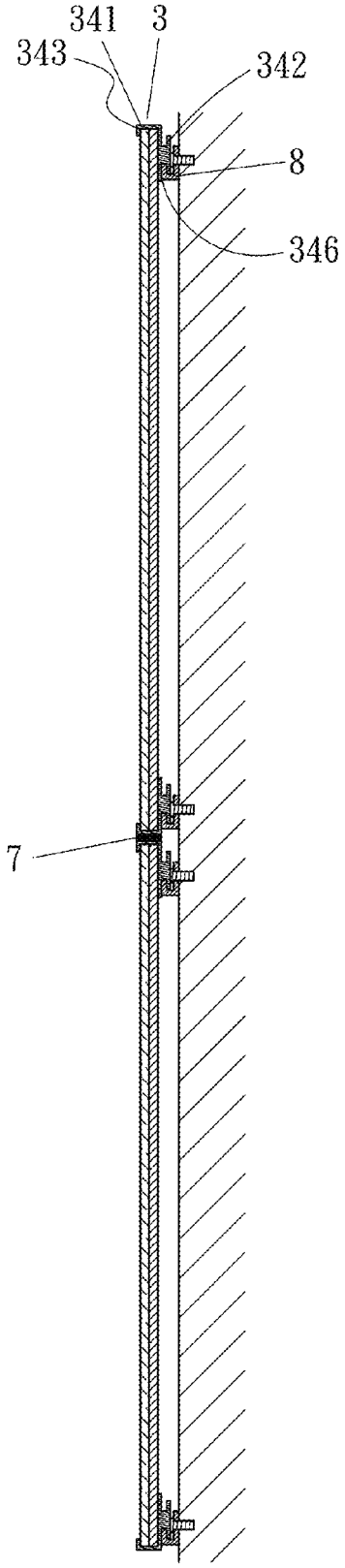
FIG. 12 is a cross sectional view of two dry-hang wall panels of FIG. 11 mounted to a wall.

FIGS. 11 and 12 show a fifth example of the wall panel similar to the second example, wherein a groove 346 is defined in the frame section 342 of each elongated beam 34. Hangers 8 can be fixed to a wall face and engaged with the groove 346 of the rear frame 3 without using hooks, providing assembling convenience and stability.

In view of the foregoing, the wall panel according to the present invention provides enhanced utility and is suitable for proceeding with repair, modification, and face-lift of a wall face of a building because the wall panels according to the present invention is light and inexpensive, providing a smooth outer wall with a sense of quality. After dry-hang of the wall panels according to the present invention onto a wall face, semi-dry-semi-wet type construction using cement can be used. Furthermore, the rear frame 3 can be integrally formed as a single, monolithic piece, allowing easy construction. Further, in a case that the rear frame 3 has a large area, insertion holes can be formed in two sides of the rear frame 3 to increase the engagement strength between the rear frame 3 and the wall face.

Although specific embodiments have been illustrated and described, numerous modifications and variations are still possible without departing from the scope of the invention. The scope of the invention is limited by the accompanying claims.

The invention claimed is:

1. A dry-hang wall panel comprising:

a thin stone slab having a thickness of about 3-10 mm and an area, the thin stone slab having a front face and a rear face and edges extending therebetween;

a reinforcing sheet having an area corresponding to the area of the thin stone slab, with the reinforcing sheet having a front face and a rear face and edges extending therebetween, the front face of the reinforcing sheet fixed to the rear face of the thin stone slab;

a plurality of hooks; and a rear frame made of a rigid material, including i) four elongated beams connected to each other to form a rectangular structure, the beams fixed to at least the edges of the reinforcing sheet and the thin stone slab, with each of the elongated beams including 1) a coupling section, formed on a first side of each of the elongated beams for engaging the reinforcing sheet and the thin stone slab;
2) a frame section extending from the coupling section, disposed on a second side of each of the elongated beams with a thickness and a height and engaging the rear face of the reinforcing sheet;
3) a coupling groove formed by the coupling section and the frame section for receiving the edges of the thin stone slab and the edges of the reinforcing sheet for fixing the reinforcing sheet and the thin stone slab within the frame;
4) insertion holes disposed in the frame section for fixing the hooks; and
5) a lip extending from the coupling section with a thickness and a height for engaging a portion of the front face of the thin stone slab, wherein the width of the lip is less than the thickness of the frame section and the height of the lip is less than the height of the frame section;

and ii) a hollow section including a space within the rectangular structure formed in the frame section of each of the elongated beams and by the reinforcing sheet.

2. The dry-hung wall panel as claimed in claim 1, wherein the elongated beams are connected to each other by connection plates.

3. The dry-hang wall panel as claimed in claim 2, further comprising:

the ends respectively of two adjacent elongated beams fixed to each other by one of the plurality of connection plates.

4. The dry-hang wall panel as claimed in claim 2, with the reinforcing sheet fixed to the thin stone slab by glue, with the rear frame fixed to the reinforcing sheet by glue.

5. The dry-hang wall panel as claimed in claim 1, wherein the plurality of hooks are each mounted to the rear frame, with the plurality of hooks adapted to be fixed to a wall face.

6. The dry-hang wall panel as claimed in claim 1, wherein fasteners mount the dry-hang wall panel to a wall face with the fasteners extending through the hooks.

7. The dry-hang wall panel as claimed in claim 6, with a recess formed in a front face of the thin stone slab, with the lip of each of the plurality of elongated beams received in the recess.

8. The dry-hang wall panel as claimed in claim 6, with each of the plurality of elongated beams having a groove.

9. The dry-hang wall panel as claimed in claim 2, further comprising: a reinforcing rib connected between two of the plurality of elongated beams.

* * * * *